United States Patent [19]

Barr

[11] Patent Number: 4,480,349

[45] Date of Patent: Nov. 6, 1984

[54] PARTICULATE COLLECTING APPARATUS

[76] Inventor: Thomas A. Barr, Chattanooga, Tenn.

[21] Appl. No.: 544,797

[22] Filed: Oct. 24, 1983

[51] Int. Cl.[3] ..... E01H 1/04

[52] U.S. Cl. ..... 15/4; 15/84; 56/364

[58] Field of Search ..... 15/82–87, 15/340, 79; 56/344, DIG. 12, 364, 328 R

[56] References Cited

U.S. PATENT DOCUMENTS 3,872,657 3/1975 Ramacher et al. ..... 56/364 X 4,255,923 3/1981 Spaida et al. ..... 56/364

*Primary Examiner*—Edward L. Roberts

*Attorney, Agent, or Firm*—Harrington A. Lackey

[57] ABSTRACT

An apparatus for collecting particulate material from a depository surface, such as a roadway, including a front-end collecting vehicle having a front-to-rear extending passageway. Mounted within the passageway is a first or front rotary rake member, a second rotary rake member behind the first rotary rake member, and a rotary brush member behind the second rotary rake member. Preferably mounted behind the vehicle frame is a conveyor mechanism for removing debris from the vehicular frame. Both rotary rake members include a plurality of interdigitating tines which are driven to move in the same forward direction so that the tines moving beneath the rotary axes are moving and collecting the debris rearwardly within the passageway. The rotary brush member is driven in the opposite rotary direction from the rake members to pick up the debris collected by the rake members and to force the debris rearwardly upon the conveyor mechanism.

10 Claims, 9 Drawing Figures

PARTICULATE COLLECTING APPARATUS

BACKGROUND OF THE INVENTION

This invention relates to an apparatus for collecting particulate material, and more particularly to a mobile front-end loading apparatus for collecting particulate material from a roadway surface.

Street sweeping machines and front-end loader apparatus of various types are well-known in the art, as illustrated in the following U.S. patents:

U.S. Pat. No. 1,053,233, Shira, Feb. 18, 1913
U.S. Pat. No. 1,083,932, J. M. Himes, Jan. 13, 1914
U.S. Pat. No. 1,212,183, Brumbaugh, Jan. 16, 1917
U.S. Pat. No. 1,416,041, Liddle, May 16, 1922
U.S. Pat. No. 3,514,801, Raimer, Jun. 2, 1970
U.S. Pat. No. 3,626,677, Sides, Dec. 14, 1971
U.S. Pat. No. 3,766,586, Kirkovich, Oct. 23, 1973
U.S. Pat. No. 4,290,820, Swisher Jr. et al, Sept. 22, 1981

Most of the above patents disclose that it is old to utilize a rotary driven brush and a rearwardly and upwardly inclined conveyor belt on a mobile frame for sweeping, cleaning or picking up debris from a road surface beneath the frame and transferring the particulate material or debris to another location, such as a depository receptacle.

Although the Himes U.S. Pat. No. 1,083,932, discloses a pair of rotary brushes located fore and aft of each other, nevertheless, these brushes are designed to be used alternately, and are not designed to cooperate with each other.

The Swisher, Jr. et al, U.S. Pat. No. 4,290,820 discloses a pair of rotary brushes for rotating about vertical axes in advance of the vehicle to form windrows and to guide the debris toward the front rotary feeder device.

Swisher Jr., et al also discloses a rotary feeder assembly 28 which apparently has transverse slats for picking up coarse material, and a rear rotary brush 280 which is designed to brush the road surface and pick finer debris. However, these two pick-up devices do not cooperate with each other.

None of the above references disclose a combination of a pair of rotary rake members having radially extending and interdigitating tines, much less such a pair of rotary rake members cooperating with a rotary brush member for picking up and discharging the particulate material.

SUMMARY OF THE INVENTION

It is therefore an object of this invention to provide a mobile apparatus for collecting particulate material in a more efficient manner than prior particulate collecting machines.

The mobile collecting apparatus made in accordance with this invention is particularly adapted for rapidly and efficiently cleaning roadway, and other pavement, surfaces.

The particulate collecting apparatus made in accordance with this invention basically includes a mobile frame having a front-to-rear open passageway. Mounted within the passageway are a front rotary rake member, a rear rotary rake member and a rear rotary brush, sequentially mounted to cooperate with each other for picking up, collecting and discharging the particulate material encountered by the mobile apparatus as the passageway moves over the particulate material.

Each of the rotary rake members includes a transverse rotary shaft from which emanate radially a plurality of circumferentially and transversely spaced tines. Both rotary rake members are driven in the same direction so that the tines are moving forwardly over the top of their respective rotary shafts and rearwardly beneath the rotary shafts. The tines of both rotary rake members are so spaced transversely that they interdigitate with each other. Accordingly, the tines of the rear rake member are cleaning the tines of the front rake member of the residual debris caught on the front tines, and pushing the debris rearwardly toward the rotary brush member.

The rotary brush member is driven in a direction opposite to the rotary direction of the front and rear rake members to pick up and gather debris fed to the brush member by the second rotary rake member as well as to pick up debris upon the supporting roadway surface and to carry the debris by centrifugal force rearwardly to a discharge point or station, such as a conveyor mechanism.

Without the second rotary rake member, the tines of the rotating first rake member, although thrusting considerable debris collected from the supporting pavement rearwardly, would tend to carry some of the debris forward and throw it upon the pavement for re-collection, which would produce an inefficient operation.

The cooperating front and rear rotary rake members tend to concentrate the debris collected, primarily by the front rotary rake member, with a minimum of spillage, and to present a larger quantity of debris to the rotary brush member for each revolution of the tines, as opposed to the collecting capacity of a single rotary rake member. Thus, the machine may operate more efficiently and the rotary brush member may be driven at a faster speed in order to handle and discharge a greater quantity of debris per revolution.

In a preferred form of the apparatus, a material guide shield is positioned substantially transversely over the brush to confine the discharge path of the material carried between the brush elements toward the discharge conveyor or station.

Both the tines of the first rotary rake member and the rotary brush member are spaced closely adjacent the supporting surface over which the apparatus moves to facilitate picking up and cleaning of coarse and fine debris by the respective rake tines and brush elements.

DESCRIPTION OF THE PREFERRED EMBODIMENT

Figure 1:
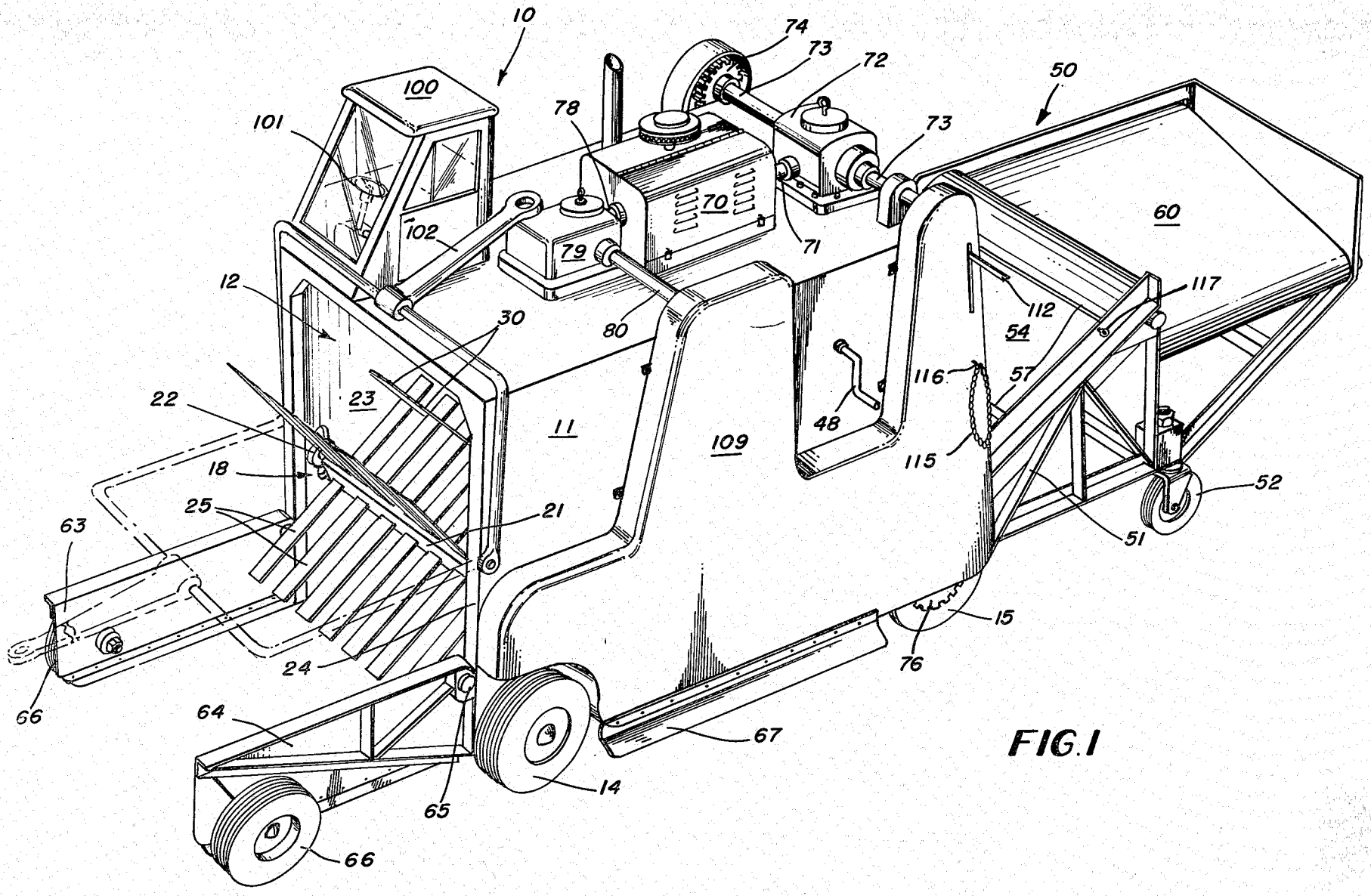
FIG. 1 is a front, top and left-side perspective view of the apparatus made in accordance with this invention.

Referring now to the drawings in more detail, the apparatus 10 made in accordance with this invention includes an elongated mobile frame or housing 11 having an elongated tunnel-like passageway 12 extending from the front to the rear of the mobile frame 11, and being completely open throughout the length of the passageway 12. The frame 11 is supported for longitudinal movement by front wheels 14 and rear wheels 15 over a supporting or depository surface 16, such as a roadway or pavement.

The elongated passageway 12 has a substantially inverted U-shaped transverse cross-section, open at the bottom.

Figure 4:
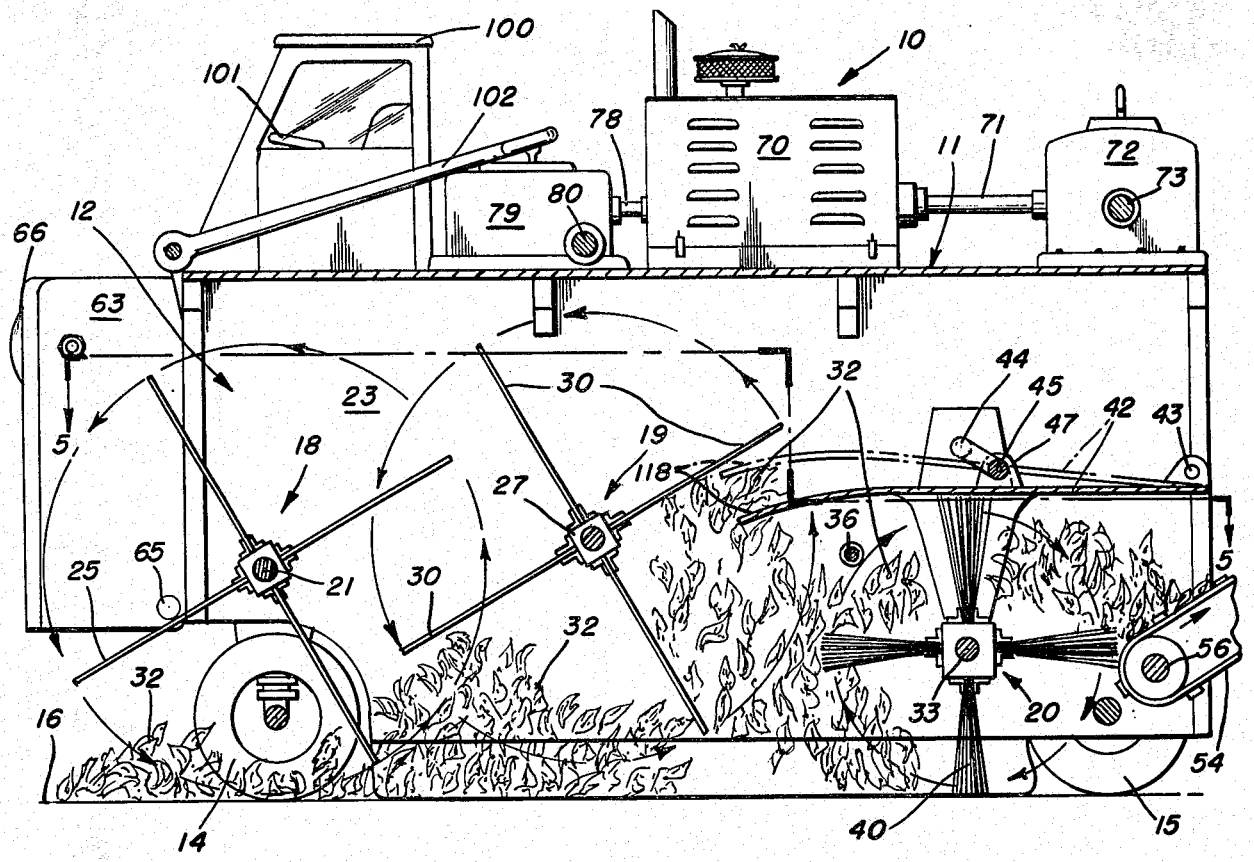
FIG. 4 is a section taken along the line 4—4 of FIG. 3.

Supported transversely within the passageway 12, and sequentially spaced from front-to-rear, are a front rotary rake member 18, a rear rotary rake member 19 and a rotary brush member 20, as best disclosed in FIG. 4.

The front rotary rake member 18 includes a transversely extending rotary shaft 21 journaled in the bearings 22 mounted in the opposed side walls 23 and 24 of the passageway 12.

Figure 5:
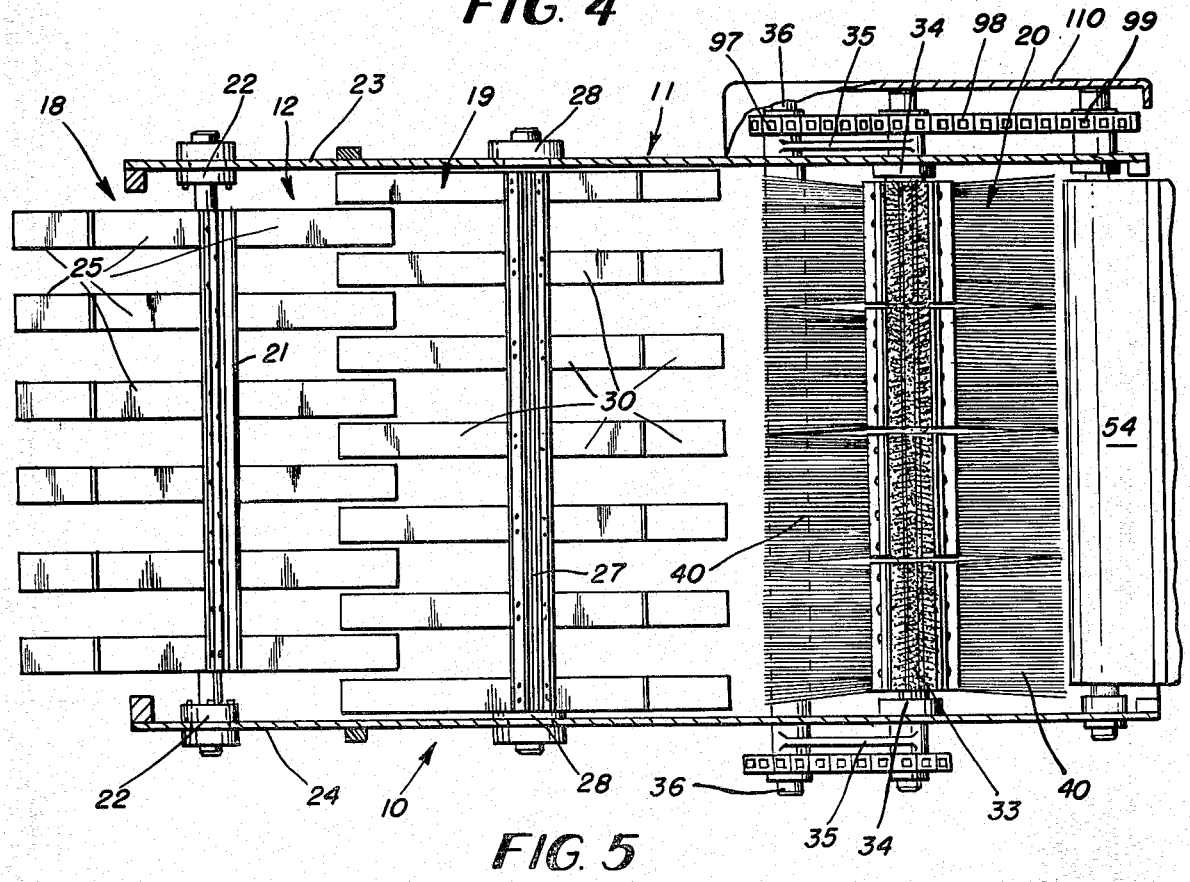
FIG. 5 is a fragmentary section taken along the line 5—5 of FIG. 4.

As best disclosed in FIGS. 4 and 5, a plurality of paddle-like tines 25 are fixed to and extend radially from the rotary shaft 21. The tines 25 are uniformly circumferentially spaced in transversely spaced sets of, for example, four tines each at 90° intervals, as disclosed in FIG. 4. The tines 25 are preferably of uniform length and width, and transversely spaced at uniform intervals, so that each set of 4 circumferentially spaced tines will rotate in the same vertical path. The height of the rotary shaft 21 above the bottom edge of the frame 11, or depository surface 16, and the length of the tines 25 is such that the tips of the tines, in their lowermost position, will barely clear the depository surface 16 during the rotary sweep of the rake member 18. The shaft 21 is driven in the direction of the arrows disclosed in FIG. 4, that is in a counter-clockwise direction as viewed from the left side of the frame 11. Thus, the tines 25 will rotate forward as they move over the top of the rotary shaft 21 and will be moving rearward during their lower sweep below the shaft 21.

The rear rotary rake member 19 is preferably constructed of identical elements, of identical size, as the front rotary rake member 18.

The rear rotary rake member 19 includes a rotary transverse shaft 27 having its opposite ends journaled in the bearings 28 in the opposed side walls 23 and 24.

Fixed to, and radiating from, the rotary shaft 27 are a plurality of paddle-like tines 30, preferably of identical size and shape as the front tines 25. The tines 30 have substantially the same circumferential spacing as the tines 25 and also the same transverse spacing. As disclosed in FIG. 4, the tines 25 are spaced circumferentially at equal intervals of 90°. Moreover, each set of 4 circumferentially spaced rear tines 30 are located in the same vertical plane so that each set sweeps through the same vertical path. The transverse spacing of the sets of tines 30 is also substantially the same as the spacing between the sets of front tines 25, that is slightly greater than the width of the respective tines. However, the rear tines 30 are offset transversely approximately the width of a tine, so that the paths of the sets of rear tines 30 are between the paths of the sets of the front tines 25.

The rear rotary shaft 27 is spaced rearwardly of the front rotary shaft 21 a distance greater than the radial length of each of the tines 25 and 30, but substantially closer by a distance substantially less than twice the length of each tine 25 or 30. Thus, as disclosed in FIGS. 4 and 5, the rotary path of the tines overlap each other, but are offset between each other, to permit the tines 30 to interdigitate with the tines 25.

The rotary shaft 27 is also preferably driven in the same rotary direction as the rotary shaft 21, so that the tines 30 and 25 are rotating in the same direction. The tines 30 are moving forward through their upward sweep across the top of the rotary shaft 27, while the rotary sweep of the tines 30 beneath the shaft 27 is in a rearward direction.

Also, in a preferred form of the invention, the rear rotary shaft 27 is spaced slightly higher than the elevation of the rotary shaft 21. Thus, as the front tines 25 collect debris 32 from the supporting surface 16 and move the debris rearwardly and then upwardly, the forward and downward moving rear tines 30 intercept the debris 32 carried upward by the front tines 25 moving through their rear quadrants, and force that debris 32 downward and rearward. Such action prevents the front tines 25 from throwing excess debris 32 forward in front of the mobile frame 11.

The rear tines 30 not only clean the front tines 25 and collect the excess debris from the upwardly moving front tines 25, but also engage the remaining debris 32 and move it rearward toward the rotary brush member 20.

The rotary brush member 20 includes a transversely mounted rotary shaft 33, the ends of which are mounted in opposed bearings 34 supported in the free ends of the swing or radial arms 35, and secured by lock nuts 38. The opposite ends of the swing arms 35 are journaled upon the transverse shaft 36 fixed in the opposite walls 23 and 24 of the passageway 12. The end portions of the brush shaft 33 extend through arcuate slots 37 of limited length to permit the shaft 33 to be raised and lowered when the brush member 20 encounters an uneven surface, or obstacles on the ground surface 16. The brush shaft 33 may be held in an elevated adjusted position relative to the slot 37 by means, not shown, if desired.

Radiating from the brush shaft 33 are a plurality of brush elements or bristles 40 which extend transversely in circumferentially spaced rows. In FIG. 4, the bristles 40 are arranged in four transverse rows spaced in uniform increments of 90°. The brush elements or bristles 40 have uniform radial lengths and bristle tips sweep through a rotary path substantially contiguous with the tip path of the tines 30 of the rear rotary rake member 19. Furthermore, the rotary shaft 33 is driven in a direction opposite to the rotary directions of the rake members 18 and 19. Thus, as disclosed by the arrows in FIG. 4 the rotary direction of movement of the bristles 40 is clockwise, as viewed from the left side of the apparatus 10.

Preferably, the shaft 33 is set in a position in which the bristle tips will just touch or engage the depository surface 16 as the apparatus 10 moves over the surface 16, so that the rotary bristles 40 will sweep clean the fine debris lying on the surface 16.

The brush elements or bristles 40 are circumferentially spaced apart to provide spaces or pockets between the transverse rows of bristles 40 in order to capture and retain the debris 32 as the bristles 40 sweep the debris upward and rearwardly above the brush shaft 33.

To prevent the centrifugal force of the rotating brush elements 40 from throwing debris upward into the upper portion of the passageway 12, a guide shield 42 of solid material is mounted to extend substantially horizontally transversely of the passageway 12 closely above the rotary paths of the bristles 40, as best disclosed in FIG. 4. The guide shield 42 is also preferably made adjustable manually, by supporting its rear edge upon a transverse pivot rod 43. An elongated crank rod 44 is journaled in the opposite side walls 23 and 24 and its eccentric portion 45 extends through a slot 46 in a bracket 47 attached to the top of the shield 42. The left end portion of the crank rod terminates in a handle 48, as best disclosed in FIG. 7. Normally, the shield 42 will remain in its lowermost position closely adjacent the tip paths of the bristles 40 to contain the debris 32 between the bristle rows as the brush member 20 rotates, to cause the debris 32 to be moved over the top of the brush shaft 33 rearwardly. In the event that the brush member 20 becomes jammed with excessive debris 32, the handle 48 may be rotated to lift the shield 42 to its elevated phantom position disclosed in FIG. 4, to permit excessive debris 32 to be removed from the brush member 20.

Figure 7:
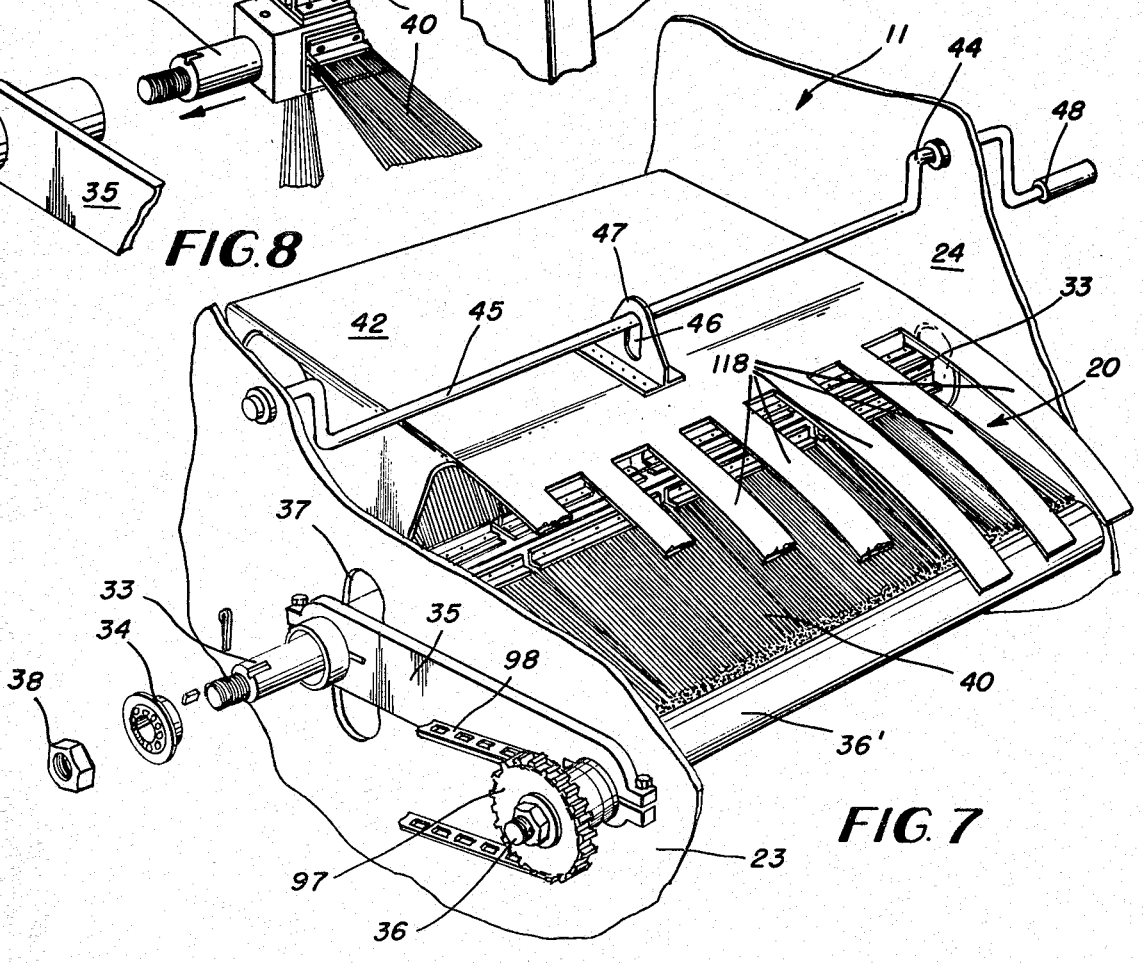
FIG. 7 is a top, front, fragmentary perspective view of the mounting assembly for the rotary brush member.

As best disclosed in FIG. 7, the front portion of the guide shield 42 preferably forms a plurality of uniformly transversely spaced, elongated, substantially flat, fingers 118, which project forwardly into the rotary path of the rear rake member 19, as disclosed in FIG. 4. The elongated fingers 118 lie in vertical planes which are offset from, or alternate with, the vertical rotary paths of the rear tines 30. That is, the rear tines 30 rotate in the spaces between the fingers 18. Thus, the relatively stationary fingers 118 strip debris carried upwardly by the rear tines 30, causing the stripped debris to fall downwardly into the upward sweeping path of the rotary brush bristles 40. The spaces between the fingers 118 terminate at their rear end portions to provide sufficient clearance for the rotary rear tines 30, but not so far rearwardly that debris will be carried upward by the bristles 40 above the guide shield 42.

Preferably, a conveyor mechanism 50 is attached to the rear end of the housing 11, to provide a means for disposing of the collected debris 32.

Figure 6:
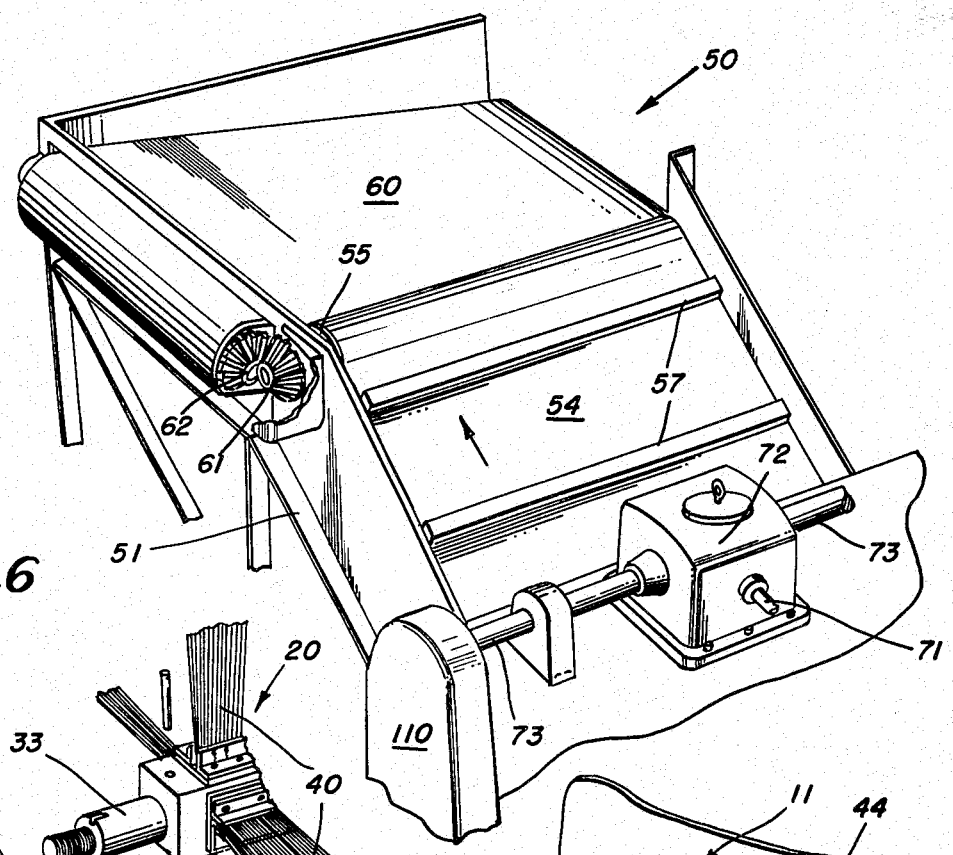
FIG. 6 is a top, front, fragmentary perspective view of the conveyor mechanism.
Figure 8:
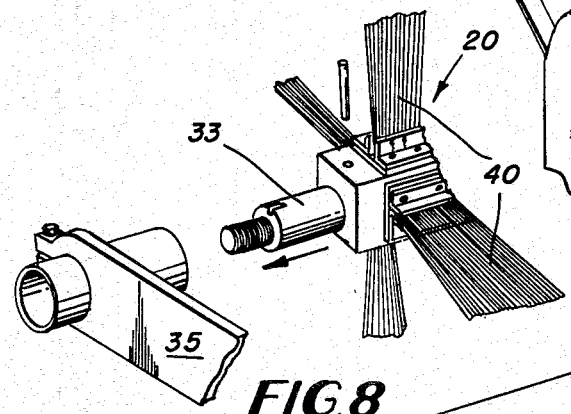
FIG. 8 is an enlarged fragmentary, perspective, exploded view of the right end portion of the rotary brush member.
Figure 9:
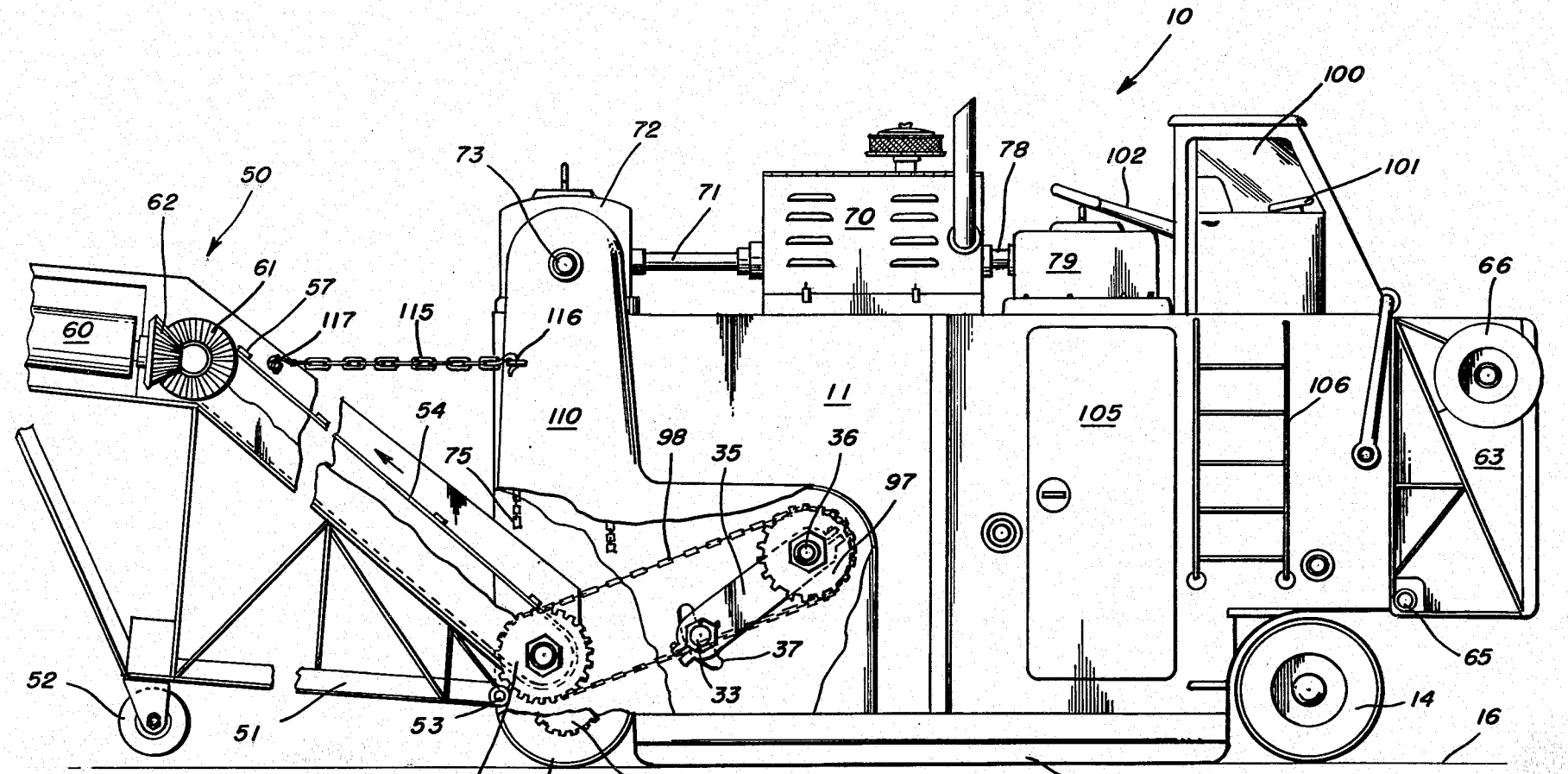
FIG. 9 is a right-side elevational view of the apparatus, with portions broken away, and showing the conveyor mechanism fragmentarily.

As disclosed in the drawings, and particularly FIGS. 1, 6 and 9, the conveyor mechanism 50 includes a trailer frame 51 supported on wheels 52 and connected by connector pins 53 to the rear end of the housing 11 (FIG. 9).

Mounted on the frame 51 is an inclined belt conveyor 54 trained about an upper roller 55 (FIG. 6) and a lower roller 56 (FIG. 4). The inclined belt member 54 may be provided with longitudinally spaced transverse slats or ribs 57. The inclined conveyor belt 54 is driven so that the upper leg of the belt moves upward and rearward, as disclosed by the arrows in FIGS. 6 and 9.

The debris 32 carried upward and rearward by the inclined conveyor belt 54, which moves in a longitudinal direction relative to the frame 11, is deposited upon a second transversely extending conveyor belt 60 which is also supported on rollers, hidden by the belts in the drawings, and inclined slightly downward toward the left of the frame 11, as disclosed in FIG. 1. The belt conveyor 60 is also mounted upon the trailer frame 51. The belts 54 and 60 are driven in synchronism through the intermeshing bevel or miter gears 61 and 62 (FIG. 6). The miter gear 61 is fixed to the head roller 55 of the conveyor belt 54, while the miter gear 62 is fixed to one end of the head roller, not shown, carrying the belt 60.

The debris deposited upon the transversely moving declining conveyor belt 60 may be deposited into the bed of a truck moving alongside the apparatus 10, or may be deposited along the side of the road for future removal by other apparatus.

As disclosed in FIG. 9, when the conveyor mechanism 50 is not being used, and it is being towed from one location to another by the apparatus 10, the trailer frame 51 may be held in an elevated position, so that the wheels 52 do not touch the road surface 16, by an elongated flexible chain 115 terminating at its opposite ends in hooks which engage eyelets 116 and 117 on the frame 11 and the trailer frame 51, respectively. When the conveyor mechanism 50 is in its operative position, the chain 115 is released from the eyelet 117, and both hooked ends of the chain 115 are suspended on the eyelet 116, as disclosed in FIG. 1.

In a preferred form of the apparatus 10, a pair of forwardly projecting, vertically disposed, guide panels 63 and 64 are pivotally mounted by journal pins 65 to the front portions of the side walls 23 and 24. In their forwardly projecting, operative positions, disclosed in FIG. 1, the guide panels 63 and 64 extend substantially horizontally forward, with their front ends supported on the depository surface 16 by wheels 66.

The function of the guide panels 63 and 64 is to guide loose debris 32 lying on the supporting surface 16 in front of the forward moving apparatus 10, between the guide panels 63 and 64, and to form a windrow for collection by the front rotary rake member 18.

Figure 2:
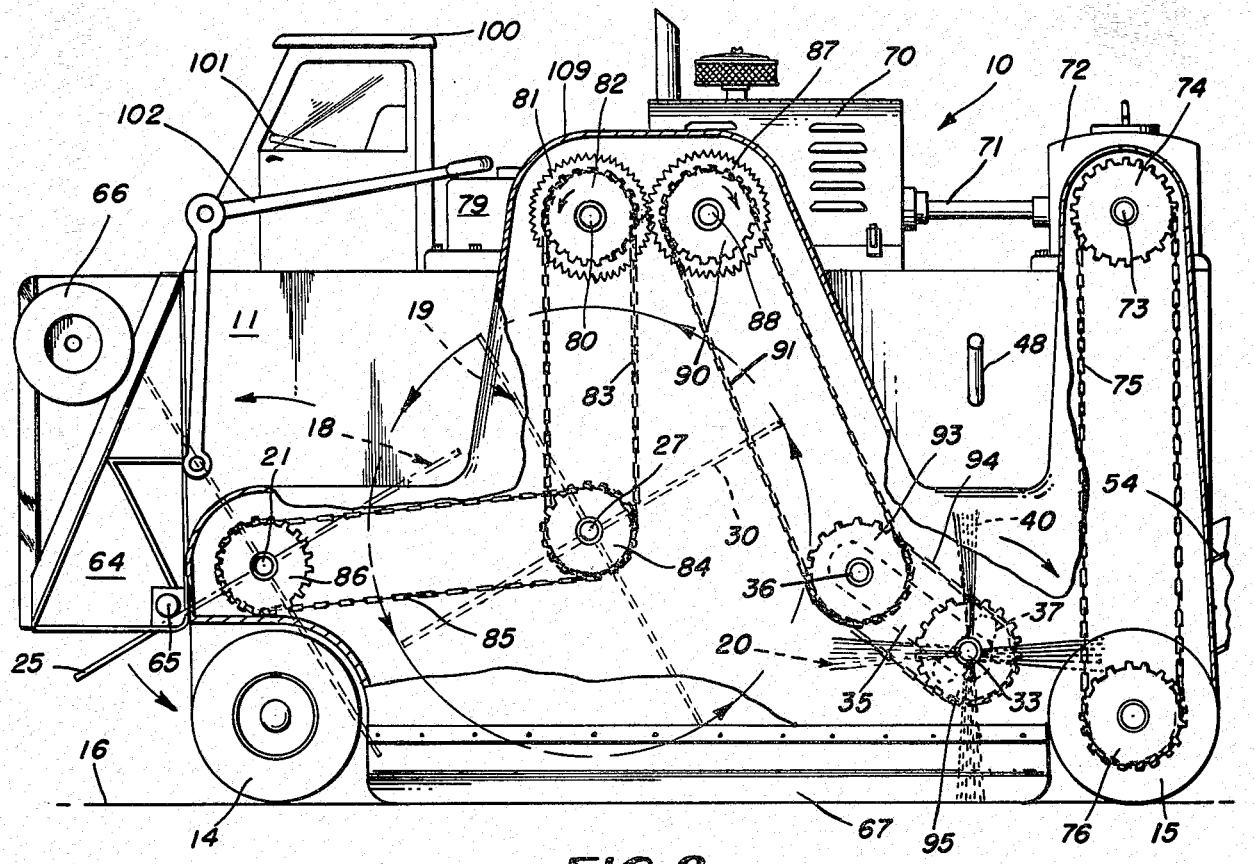
FIG. 2 is a left-side elevation of the apparatus disclosed in FIG. 1, with the conveyor mechanism broken away, the front guide members pivoted to their upright inoperative positions, and portions of the left side wall broken away to disclose the drive transmissions.
Figure 3:
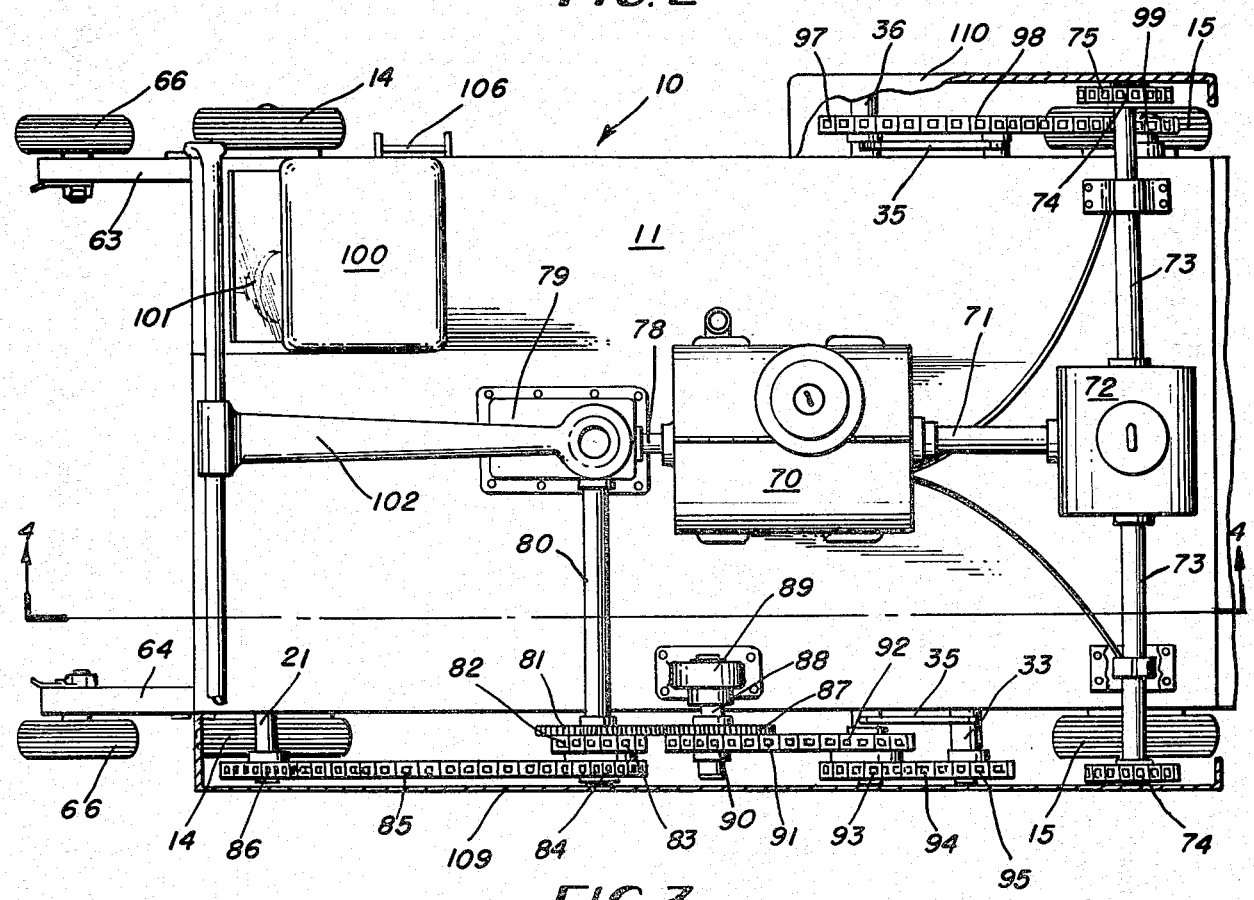
FIG. 3 is a top plan view of the apparatus disclosed in FIG. 2, with portions broken away.

When the guide panels 63 and 64 are not in use, they may be rotated upward and rearward about the journal pin 65, approximately 90°, to their upright inoperative positions disclosed in FIGS. 2, 4 and 9.

In order to further confine the debris 32 within the passageway 12, flexible depending aprons 67 may be fixed to the bottom edges of the housing 11 between the front and rear wheels 14 and 15 and extend down in wiping engagement with the supporting or depository surface 16, as best disclosed in FIGS. 1, 2 and 9.

In the preferred form of the invention, the apparatus 10 is not only mobile, but self-propelled. As best disclosed in FIGS. 1,2,3,4 and 9, a motive power means, such as the internal combustion engine 70, is mounted on top of the housing 11. The rear power shaft 71, projecting from the rear of the engine 70, drives a differential mechanism 72, which in turn drives the transverse drive shaft 73 projecting transversely beyond the sides of the housing 11 and upon which are fixed a pair of opposed drive sprockets 74. Each drive sprocket 74 is connected by an endless chain 75 to a corresponding driven sprocket 76 coaxially fixed to a rear wheel 15. Thus, the apparatus 10 is propelled normally in a forward direction by means of the engine 70 transmitting power to the rear wheels 15 through the differential 72.

A front power shaft 78 driven by the engine 70, drives the gear reducer mechanism 79, which in turn drives the transmission drive shaft 80 at a reduced speed. Fixed to the transmission drive shaft 80 is a gear 81 and an upper sprocket 82. The upper sprocket 82 drives a chain 83, carried about a lower sprocket 80, not shown, fixed upon the rotary shaft 27 of the rear rotary rake member 19. A second sprocket 84 fixed to the rear rotary shaft 27 drives a chain 85 trained about the driven sprocket 86 fixed to the front rotary shaft 21 of the front rotary rake member 18. The sprockets 84 and 86 are preferably the same size, so that the shafts 27 and 21 of the corresponding rear rake member 19 and front rake member 18 are driven at the same speed.

Intermeshing with the front gear 81 is the rear gear 87 fixed to jack shaft 88, journaled in bearing 89 supported on top of the housing 11. Also fixed to the jack shaft 88 is an upper sprocket 90 carrying a chain 91 which is trained about the lower sprocket 92 journaled upon the shaft 36. Also journaled to the shaft 36 is another sprocket 93 carrying a chain 94 trained about the sprocket 95 fixed to the rotary brush shaft 33.

In this manner, the transmission shaft 80 simultaneously drives the front rake member 18, the rear rake member 19 and the rotary brush member 20 in their respective rotary directions as disclosed by the arrows in FIG. 4.

Also fixed to the right end portion of the shaft 36 is a drive sprocket 97 carrying a chain 98 which is trained over a driven sprocket fixed to the shaft of the lower roller 56 of the conveyor belt 54. Thus, both conveyor belts 54 and 60 are driven in synchronism with the rotary brush 20, as well as the front and rear rotary rake members 18 and 19, from the same drive transmission shaft 80.

The apparatus 10 preferably includes a cab 100 in which the operator may be seated for controlling the operation of the apparatus 10. The wheels 14 may be made steerable by steering linkages, not shown, in response to the steering wheel 101 (FIGS. 1 and 9).

The apparatus 10 may be adapted for towing behind a prime mover, if desired. For example, a tow bar 102 may be pivotally mounted upon a yoke member 103 journaled to the front portion of the housing 11, as disclosed in FIG. 1. The tow bar 102 is shown in solid lines in its inoperative position in FIG. 1, and in its operative position in phantom in FIG. 1. The tow bar 102 may be used to tow the apparatus 10 from a storage location to a working station.

The top wall of the housing 11 may be made transparent, or be provided with transparent panels, so that the interior of the passageway 12 may be visible to the operator within the cab 100, for observation and detection of any malfunctions.

Slip or torque clutches may be incorporated in the transmission drives between the transmission shaft 80 and the rake shafts 21 and 27 and the rotary brush member shaft 33 to permit yielding or slipping if any of the respective moving parts become jammed from overloading or blockages in the movement of the debris 32.

The conveyor belts 54 and 60 may be provided with tunnel-like covers, if desired, to assure the complete containment of the debris as it moves over the conveyor belts 54 and 60.

Sprinkler systems may be provided over the conveyor belts 54 and 60, if desired, in order to dampen excessively dry or fine debris.

As best illustrated in FIG. 9, an access door 105 may be included in the housing 11 to provide entry into the passageway 12 in order to facilitate maintenance of the internal parts.

A ladder 106 is fixed to the right side of the housing 11 to permit the operator to climb to the cab 100.

All of the transmission elements such as the gears, sprockets and chains may be protected by the cover members 109 and 110, if desired.

The speed of the various rotary shafts, such as the rake shafts 21 and 27 and the brush shaft 33, as well as the conveyor belts 54 and 60, may be varied by appropriate variable controls. For example, the sprockets could be substituted with variable speed pulleys and the chain substituted with belts carried about the variable speed pulleys.

The signal arm 112, disclosed in FIG. 1, may be provided to indicate to the truck driver driving a truck alongside the apparatus 10, that the truck bed is in proper position relative to the transverse conveyor belt 60 for depositing the debris from the belt 60 into the truck bed.

The trailer wheels 52 may be swivelly mounted to the frame 51 to facilitate turning of the conveyor mechanism 50 with the apparatus 10.

If desired, the tines 25 and 30 of the rotary rake members 18 and 19, respectively, could be made of an elastic material, such as spring steel or other spring metals, to permit the respective tines 25 and 30 to yield if they encounter any fixed or rigid obstacles in their rotary paths as the apparatus 10 moves over the surface 16 to be cleaned. Such elastic construction of the tines 25 and 30 would minimize the possibilities of damage to the tines should they encounter fixed or rigid obstacles.

It is also within the scope of this invention to fabricate the tines 25 and 30 independently, or in sets, so that in the event of damage or wear to individual tines, the independent tines or sets of multiple tines, such as a pair of tines, can be removed and replaced, without replacing the entire rake member 18 and 19. Furthermore, it is preferred that the rake members 18 and 19, as well as the brush member 20, be detachably mounted in their respective bearings 22, 28 and 34 so that each of the respective rake or brush members may be readily removed for repair, inspection or replacement by simply axially removing the corresponding shaft from the hub or shaft housing forming the core of each of the rake and brush members 18, 19 and 20. The rotary brush member 20 may also be fabricated in sections to facilitate removal and replacement of damaged or worn sections, rather than the entire brush member 20.

It will therefore be seen that the apparatus 10, with its uniquely constructed dual rotary rake members and oppositely rotating brush member, provides an apparatus for loading, collecting and discharging particulate material of various sizes from a depository surface 16, such as a roadway, pavement or staorage area, in a more efficient manner than comparable machines heretofore known.

What is claimed is:

1. An apparatus for collecting particulate material from a depository surface, comprising:

(a) a vehicular frame having a front end, a rear end, a top wall and opposed side walls defining an elongated passageway extended from front-to-rear through said vehicular frame, (b) a first rotary rake member, (c) a second rotary rake member, (d) each of said rotary rake members comprising an elongated shaft and a plurality of tines, having free extremities, extending radially of said corresponding shaft and spaced longitudinally and circumferentially of said corresponding elongated shaft, (e) first mounted means supporting the shaft of said first rotary rake member in said passageway about a first transverse axis, so that said free extremities clear the depository surface over which said vehicular frame moves during rotation of said tines, (f) second mounting means supporting the shaft of said second rotary rake member in said passageway for rotary movement about a second transverse axis spaced behind said first transverse axis, so that the tines of said second rotary rake member interdigitate with the tines of said first rotary rake member during rotation of said rotary rake members, (g) means for driving the shafts of both rotary rake members in the same rotary direction so that the tines moving beneath the respective shafts are moving rearwardly through said passageway, (h) a rotary brush member, (i) means mounting said rotary brush member within said passageway behind said second rotary rake member for rotation about a transverse axis spaced behind the transverse rotary axis of said second rotary rake member a distance sufficient to permit the periphery of said brush member to pass closely adjacent the rotary path of the free extremities of the tines of said second rotary brush member, (j) means for driving said rotary brush member in a rotary direction opposite to the rotary directions of said first and second rotary rake members, (k) depository means for receiving particulate material from said rotary brush member, and (l) motive means for moving said vehicular frame longitudinally forward over a depository surface.

2. The invention according to claim 1 in which the depository means comprises conveyor means behind said rotary brush member for conveying particulate material away from said brush member.

3. The invention according to claim 2 in which said conveyor means comprises a first endless conveyor belt means and a conveyor frame connected to the rear end portion of said vehicular frame and supporting said belt conveyor member to incline upward and rearwardly, with the lower portion of said conveyor belt means being located adjacent and substantially on the same level as the rotary axis of said brush member, and a second conveyor belt member mounted behind said first conveyor belt member for transverse movement to receive particulate material from said first belt member and to transport said debris transversely of said vehicular frame passageway.

4. The invention according to claim 3 further comprising conveyor drive means for synchronously driving said first and second conveyor belt members.

5. The invention according to claim 1 in which said second mounting means supports said shaft of said second rotary rake member a predetermined distance above the height of the rotary shaft of said first rotary rake member, and the tines of said first and second rotary rake members have substantially equal radial extents from their corresponding rotary axes.

6. The invention according to claim 1 in which the circumferential path of the periphery of said rotary brush member is substantially tangent to the peripheral path of the free extremities of the tines of said second rotary rake member.

7. The invention according to claim 1 further comprising a shield member mounted transversely of said passageway and immediately above said rotary brush member for confining the path of particulate material carried by said rotary brush member toward said depository means.

8. The invention according to claim 7 in which said shield member comprises forwardly projecting fingers interdigitating with the tines of said second rotary rake member.

9. The invention according to claim 1 in which said tines of said first and second rotary rake members are of substantially equal width and the tines of said first rotary rake member are staggered relative to the tines of said second rotary rake member so that the tines of said first and second rotary rake members have alternating rotary paths.

10. The invention according to claim 1 further comprising a pair of particulate guide members having vertically disposed guide panels, means pivotally mounting said guide panels on the front end portions of said respective side walls for movement between a forwardly projecting operative position for guiding particulate material between said guide panels toward said first rotary rake member, and an upper inoperative position.

* * * * *